United States Patent [19]

Takahashi

[11] Patent Number: 4,474,326

[45] Date of Patent: Oct. 2, 1984

[54] ULTRASONIC ATOMIZING DEVICE

[75] Inventor: Minoru Takahashi, Tokyo, Japan

[73] Assignee: TDK Electronics Co., Ltd., Tokyo, Japan

[21] Appl. No.: 439,908

[22] Filed: Nov. 8, 1982

[30] Foreign Application Priority Data

| | | | |
|---|---|---|---|
| Nov. 24, 1981 | [JP] | Japan | 56-173231[U] |
| Feb. 15, 1982 | [JP] | Japan | 57-21197[U] |
| Feb. 20, 1982 | [JP] | Japan | 57-22136[U] |
| Apr. 21, 1982 | [JP] | Japan | 57-58272[U] |

[51] Int. Cl.[3] ..... B05B 17/06

[52] U.S. Cl. ..... 239/102; 310/325; 310/330; 310/348

[58] Field of Search ..... 431/1; 261/DIG. 48; 239/4, 102; 310/311, 325, 326, 330, 331, 334, 345, 348, 351–353

[56] References Cited

U.S. PATENT DOCUMENTS

| | | | |
|---|---|---|---|
| 2,651,148 | 9/1953 | Carwile | 239/102 X |
| 3,292,910 | 12/1966 | Martner | 239/102 X |
| 3,738,574 | 6/1973 | Guntersdorfer et al. | 239/102 |

*Primary Examiner*—Andres Kashnikow

*Attorney, Agent, or Firm*—Ratner & Prestia

[57] ABSTRACT

An ultrasonic atomizing device includes an ultrasonic oscillator system and a housing. The oscillator system comprises a conic-frustum shaped coupler having a projection at the central portion of its large cross-sectional portion, a circular piezoelectric plate provided with electrode plates and having a center hole through which being penetrated the projection, and a resonance plate to be stimulated into vibration. On the other hand, the housing includes a cylindrical wall, a circular cover fixed at one end of the cylindrical wall and a ring shaped cover fixed at the other end of the cylindrical wall. A circular hole of the ring shaped cover accepts and flexibly supports the coupler through a ring shaped rubber packing. The surface of the oscillator is sealed with the housing by fixing the circular cover to the projection by means of screws, in order to prevent invasion or adhesion of liquid to the surface of the oscillator.

10 Claims, 11 Drawing Figures

ULTRASONIC ATOMIZING DEVICE

BACKGROUND OF THE INVENTION

1. Field of the Invention

The present invention relates to an ultrasonic atomizing device, more particularly, to an ultrasonic atomizing device which is preferably used for an oil burner and the like.

2. Description of the Prior Art

An ultrasonic atomizing device has been employed, for example, in an oil burner and the like in order to atomize fuel oil and supply it to the combustion chamber of the burner.

The present inventor has proposed in Japanese Patent Application No. 127847/81 an ultrasonic atomizing device utilizing a coupler (horn) as a mechanical vibration connecting member, which is shown in FIG. 1. In the figure, the ultrasonic atomizing device includes an ultrasonic oscillator system 1 which comprises a conic-frustum shaped coupler 2, a piezoelectric oscillator 3 and a circular resonance plate 4. The conic-frustum shaped coupler 2 includes a large cross-sectional surface, a small cross-sectional surface and a conical surface. The piezoelectric oscillator 3 is disc-like and is provided with the respective circular electrode plates (not shown) on its respective surfaces. A pair of feed conductors (also not shown) are attached to respective electrode plates. The piezoelectric oscillator 3 effecting bending vibration and provided with the electrode plates, is attached to the large cross-sectional surface of the coupler 2. The resonance plate 4 whose material is same as that of the coupler 2 is integrally formed with the small cross-sectional surface of the coupler 2. A supporting groove 5 is formed in the coupler 2 and a supporting member 6 is fitted into the supporting groove 5, as shown in FIG. 1. By this supporting member 6, the ultrasonic oscillator system 1 is flexibly supported. The supporting member 6 has an opening 7 through which a blast of wind W is passed. Liquid to be atomized is supplied from one end of a liquid supply pipe 8 to the operative surface of the resonance plate 4, where the atomized liquid particles are mixed with the blast wind W. Since the piezoelectric oscillator 3 is not sealed with a case or the like in the device having the abovementioned structure, it has a disadvantage that dust or the like included in the blast wind is apt to adhere to the surface of the oscillator 3, or liquids to be atomized are apt to invade the surface of the oscillator 3, which impairs the vibration performance of the device or causes a short-circuit of the electrodes.

Therefore, it has been required and considered to make the oscillator 3 be a sealed structure in order to prevent invasion of the blast wind or liquid particles onto the surface of the oscillator 3. However, there has been a problem in the conventional ultrasonic atomizing device such that the total mass of the ultrasonic oscillator system 1 was designed to be supported at the conical surface of the coupler 2. That is, if a sealing member was mounted on a portion other than the supporting portion of the coupler 2 so as to seal up the oscillator 3, its vibration has been apt to be clamped. Moreover, in order to carry out the sealing of the oscillator 3 by mounting the sealing member on the supporting portion of the coupler 2 and to strengthen the mounted portion, it is required that the supporting member be larger in size and more rigid. Also in this case, it occurs the disadvantage that the vibration may be clamped.

On the other hand, when the liquid to be atomized is supplied from the liquid supply pipe 8 to the operative surface of the resonance plate 4, there is a fear that part of liquid may drop from the operative surface before atomization in case where surface tension or viscosity of the liquid is small. As a result, liquid particles of a uniform size cannot be obtained. An usual conventional atomizing device utilizing a coupler has been so designed that liquid particles atomized on the operative surface of the resonance plate be sent out in a desired direction by forced blast. However, at the same time, non-atomized liquid particles dropped from the resonance plate may sometimes be sent out by the forced blast. Especially in the case where the device is applied to an oil burner, it has the disadvantage that liquid particles dropped from the resonance plate may be entered into the combustion chamber, which causes an incomplete combustion.

Moreover, in a conventional ultrasonic atomizing device incorporating a Langevin type ultrasonic oscillator system with a conic-frustum coupler which utilizes a resonance vibration in the longitudinal direction of the coupler, a dimension of the small cross-sectional surface of the coupler has been designed to be smaller compared to a wavelength of ultrasonic waves in order to increase the ratio of a displacement ($\xi_2$) of a peripheral portion to a displacement ($\xi_1$) of a central portion of the resonance plate. For example, the ratio $\xi_2/\xi_1$ of about 1.64 has been employed in the conventional device. However, the device of this type utilizing the resonance vibration in the longitudinal direction of the coupler requires an accuracy in dimension of longitudinal direction of the coupler, and scattering of the sound velocity due to the coupler material thereof largely affects its vibration performance, which obstructs mass-production and causes an increase in production cost. On the other hand, in an ultrasonic atomizing device employing a coupler to be stimulated in bending vibration, the coupler undergoes a volume variation in the radial direction thereof. As a result, when a dimension of the cross-section of the connecting portion between the coupler and the resonance plate is small, a Q-value and free impedance $Z_{moo}$ of the device decreases. Accordingly, in this case, vibration energy cannot be sufficiently transmitted from the oscillator to the resonance plate on which atomization is to take place.

OBJECTS AND SUMMARY OF THE INVENTION

It is an object of this invention to provide an ultrasonic atomizing device which is designed to prevent the adhesion of dust or the like to a surface of an oscillator or invasion of liquid particles to the oscillator, without reducing its vibration performance.

It is another object of this invention to provide an ultransonic atomizing device which is designed to prevent part of liquid to be atomized from falling off from a surface where atomization is to take place, and to facilitate uniformalization in size of atomized liquid particles.

It is a further object of this invention to provide an ultrasonic atomizing device which is superior in mass productivity and excellent in efficiency.

According to an aspect of this invention there is provided an ultrasonic atomizing device comprising: an ultrasonic oscillator system comprising, a conic-frustum shaped rigid coupler including a large cross-sectional surface, a small cross-sectional surface and a conical surface, and having a projection at the central portion of its large cross-sectional surface, a circular piezoelectric plate for effecting vibration provided with electrode plates on its respective surfaces and having a center hole at the central portion thereof, the piezoelectric plate being coupled with the large cross-sectional surface of the coupler so that the projection of the coupler be inserted into the center hole, a second plate to be stimulated into vibration and integrally formed with the small cross-sectional surface of the coupler, and a pair of feed conductors electrically connected to the electrode plates, respectively, through which being supplied an AC voltage; a housing having a cylindrical wall, a circular cover fixed at one end of the cylindrical wall and a ring-shaped cover fixed at the other end of the cylindrical wall, and the ring-shaped cover having a circular hole for accepting the coupler; a ring-shaped flexible member for supporting flexibly the coupler in the hole of the ring-shaped cover; a fixing means for fixing the circular cover of the housing to the projection of the coupler; and an elongated pipe provided on the housing for supplying liquid to be atomized to the operative surface of the second plate.

BRIEF DESCRIPTION OF THE DRAWING

FIGS. 8 through 11 are views and graphs for explaining a still further modification of the ultrasonic oscillator system, in which FIGS. 8 and 9 are side views of the ultrasonic devices, respectively, and FIGS. 10 and 11 are graphs for illustrating relationships between frequency f, free impedance $Z_{moo}$ and Q value, and the connection $\phi A$, of the oscillator systems shown in FIGS. 8 and 9, respectively.

DETAILED DESCRIPTION OF THE PREFERRED EMBODIMENTS

Initially, an ultrasonic atomizing device according to a preferred embodiment of this invention will be described with reference to FIGS. 2 and 3.

Figure 1:
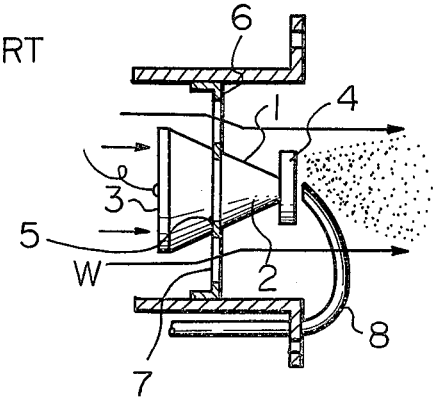
Fig. 1 PRIOR ART
FIG. 1 is a cross-sectional view of the prior art ultrasonic atomizing device.
Figure 2:
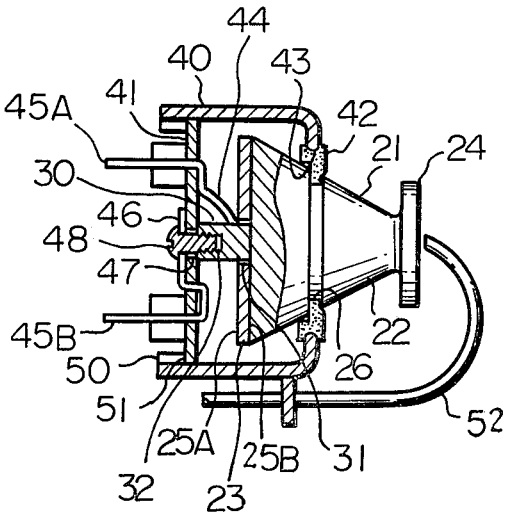
FIG. 2 is a cross-sectional view of the ultrasonic atomizing device according to this invention.
Figure 3:
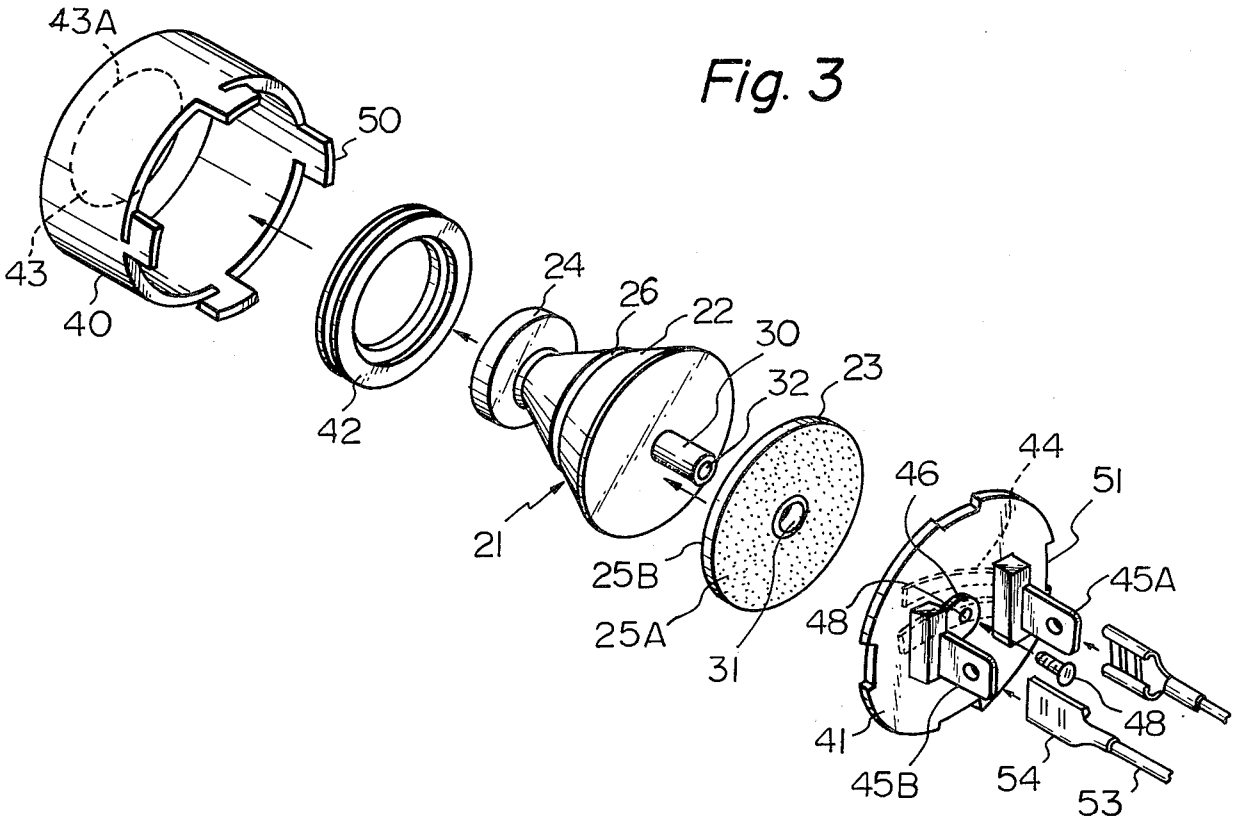
FIG. 3 is an exploded perspective view of the ultrasonic atomizing device shown in FIG. 2.

Referring to FIGS. 2 and 3, the ultrasonic atomizing device of this embodiment is illustrated therein which includes an ultrasonic oscillator system 21 comprising a conic-frustum shaped coupler 22, a circular piezoelectric oscillator 23 and a circular resonance plate 24, in a similar manner to the prior art device of FIG. 1. The conic-frustum shaped coupler 22, which serves as a mechanical vibration connecting member and is made of, for example, a rigid metallic or conductive material such as stainless steel, includes a large cross-sectional surface, a small cross-sectional surface and a conical surface. A cylindrical projection 30 in which is formed a female screw 32 is integrally formed at the central portion of the large cross-sectional surface of the coupler 22. The piezoelectric oscillator 23 which effects bending vibration is provided with respective circular electrode plates 25A, 25B on its respective surfaces. A center hole 31 whose diameter is slightly larger than that of the projection 30 is formed at the central portion of the piezoelectric oscillator 23. The circular resonance plate 24 to be stimulated in bending vibration is integrally formed with the small cross-sectional surface of the coupler 22. The resonance plate 24 may be made of the same material as that of the coupler 22. The piezoelectric oscillator 23 provided with the electrode plates 25A, 25B is attached to the large cross-sectional surface of the coupler 22 by adhesion such that the cylindrical projection 30 is inserted into the center hole 31 of the oscillator 23. An annular supporting groove 26 is formed around at the portion of the coupler 22, where a plane which is perpendicular to the center axis of the coupler 22 and which includes the mass center of the ultrasonic oscillator system 21, is intersected with the conical surface of the coupler 22.

On the other hand, a metal case 40 having a circular opening 43, a cover 41 and a ring-shaped rubber packing 42 constitutes a housing for sealing up the surface of the oscillator 23. The metal case 40 includes a cylindrical wall and a ring-shaped cover formed integrally with one end of the cylindrical wall, as shown in FIG. 3. The opening is formed in the case 40 so as to accept the coupler 22, that is to say, the resonance plate 24 and the top end portion of the coupler 22 are protruded through the opening 43. The cover 41 has a mounting hole 47 at its central portion, so that it is fixed to the cylindrical projection 30 by fastening a male screw 48 into the female screw 32, as shown in FIG. 2.

The cover 41 is provided with a connecting piece 44 of flexible metal on its surface opposing to the piezoelectric oscillator 23, while it is also provided with a terminal 45A connected to the connecting piece 44 and another terminal 45B integral with a connecting piece 46 brought into contact with the projection 30 of the coupler 22, on its other surface.

The cover 41 is mounted to the case 40 by fitting mounting pieces 50 into notches 51 formed in the cover 41 and then caulking the mounting pieces 50. In this case, the ring-shaped rubber packing 42 fits to the annular supporting groove 26 of the coupler 22 as well as being fitted into the marginal portion of the opening 43, so as to seal the clearance between the case 40 and the conical surface of the coupler 22. The electrode plate 25B provided by adhesion on one surface of the piezoelectric oscillator 23 is electrically connected through the coupler 22, the cylindrical projection 30 and the metallic screw 48 to the terminal 45B. Another electrode plate 25A provided on another surface of the oscillator 23 is electrically connected to the terminal 45A through the connecting piece 44. AC voltage for energizing the oscillator 23 is thus applied through the terminals 45A and 45B to the electrodes 25A and 25B. Receptacles 54 may be used for connection between lead wires 53 and the terminals 45A and 45B.

Furthermore, as shown in FIG. 2, a liquid supply pipe 52 is provided in the atomizing device for supplying liquid to be atomized to the operative surface of the resonance plate 24. One end of the pipe 52 is faced to the operative surface of the resonance plate 24, while another end of the pipe 52 is connected to a constant delivery pump (not shown).

Incidentally, the ultrasonic oscillator system 21 is operated so that the resonance frequenty of the resonance plate 24 agrees with that of the whole oscillator system 21.

With the ultrasonic atomizing device of the above mentioned construction, liquid is supplied to the operative surface of the resonance plate 24 from the one end of the liquid supply pipe 53 where the liquid is atomized by the vibration of the resonance plate 24 and send out uniformly in a desired direction by a forced blast supplied by a not shown means, without invasion or adhesion of part of liquid to the surface of the oscillator 23.

The ultrasonic atomizing device according to the embodiment of this invention provides following noticeable effects.

Firstly, since the cylindrical projection 30 penetrating through the piezoelectric oscillator 23 is provided at the central portion of the coupler 22 to support the total weight of the ultrasonic oscillator system 21, the supporting force at the supporting portion of the conical surface of the coupler 22 becomes nearly zero and, therefore, the surface of the oscillator 23 can be completely sealed up by employing the rubber packing 42 without imparing the vibration performance of the oscillator system. Moreover, the center hole 31 is formed at the central portion of the piezoelectric oscillator 23, where the vibratory amplitude becomes nearly zero because of the bending vibration of the oscillator 23. Therefore, the formation of the center hole in the piezoelectric oscillator 23 does not exert a bad influence on the atomizing operation.

Secondly, the case 40, the cover 41 and the rubber packing 42 constitute the housing for sealing the surface of the oscillator 23, so that adhesion of dust or the like included in a blast to the surface of the oscillator 23 as well as invasion of the atomized liquid particles to the surface of the oscillator 23, can be prevented.

When occasion demands, the supporting groove 26 of the coupler 22 may be omitted, or lead wires may be directly attached to the electrode plates fixed to the piezoelectric oscillator 23.

Figure 4:
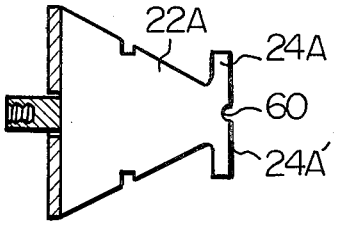
FIG. 4 is a cross-sectional view of a modification of the ultrasonic oscillator system, in which a recess is formed at the central portion of an operative surface of a resonance plate.

FIG. 4 is a first modification of the ultrasonic oscillator system of the present invention. In the modified system, a recess 60 is formed at a central portion of an operative surface 24A' of a resonance plate 24A integrally formed with a conic-frustum shaped coupler 22A, which serves as a sink for preventing liquid from dropping. Other structures of the oscillator system 22A is same as those of the device shown in FIGS. 2 and 3.

Atomizing power is stronger in a marginal portion than a central portion of the operative surface 24A' owing to the bending vibration of the resonance plate 24A. If surface tension or viscosity of liquid to be atomized is small, there is a fear that part of liquid may drop from the plate 24A before atomization. However, the provision of the recess 60 at the active surface 24A' can prevent the liquid before atomization from falling down.

According to the above modification, liquid before atomization can be easily prevented from falling down by the recess 60, thereby to facilitate the uniformalization in size of atomized liquid particles. Moreover, since the recess 60 is formed at the central portion of the resonance plate 24A at which vibratory amplitude is small, impedance variation of the piezoelectric oscillator 23A becomes small even if liquid is collected at the recess 60.

Figure 5:
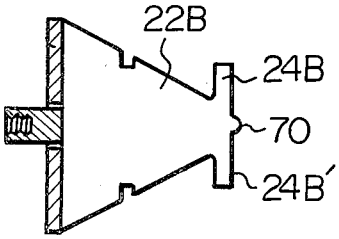
FIG. 5 is a cross-sectional view of another modification of the ultrasonic oscillator system, in which a protrusion is formed at the central portion of the operative surface of the resonance plate.

FIG. 5 is a second modification of the ultrasonic oscillator system of the present invention. In this case, a protrusion 70 is formed at the central portion of an operative surface 24B' of the resonant plate 24B for preventing liquid before atomization from dropping. Other constructions are same as those of the device shown in FIGS. 2 and 3. According to the second modification, by the provision of the protrusion 70, dropping of liquid before atomization can also be easily prevented and uniformalization in size of the atomized liquid particles can be facilitated.

Figure 6:
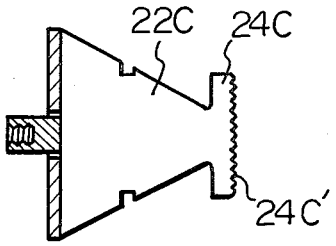
FIG. 6 is a cross-sectional view of a further modification of the ultrasonic oscillator system, in which the operative surface of the resonance plate is rough one.

FIG. 6 is a third modification of the ultrasonic oscillator system of the present invention. In the same figure, an operative surface 24C' of a resonance plate 24C is made to be a rough surface by spraying a molten metal, a ceramic and the like or by sandblasting. Other constructions are same as those of the device shown in FIGS. 2 and 3.

According to the third modification, the operative surface 24C' where atomization is to take place is designed to be the rough one. As a result, liquid to be atomized can be instantaneously maintained at a fashion of a uniform thin film on the operative surface 24C' of the resonance plate 24 due to a so-called capillary phenomenon. Accordingly, atomization of liquid can be uniformly carried out and dropping of the liquid before atomization can be effectively prevented. Moreover, a resonance frequency of the vibration can be readily designed compared with the conventional one. The design of the resonance frequency of this case substantially coincides with the theoretical one.

If a circular plate is used as the resonance plate 24C, the resonance frequency of the circular plate can be expressed as:

$$f = \frac{\alpha_{mo}^2}{2} \cdot \frac{h}{a^2} \sqrt{\frac{E}{3(1-\sigma^2)\rho}}$$

or $$\frac{\omega}{c} \cdot \frac{a^2}{h} = \frac{\alpha_{mo}^2}{\sqrt{3(1-\sigma^2)}}$$

where h is a thickness of the plate, a is a radius of the plate, $\sigma$ is a Poisson's ratio of a metal, c is a sound velocity (which is nearly equal to $3230 \times 10^2$ cm/sec), and $\alpha_{mo}$ is a normal constant. In case that h=0.1 (cm), a=0.5 (cm), $\sigma \approx 0.3$ (when employing stainless steel), and $\alpha_{mo} \approx 3.00$ (at a first resonance mode), the resonance frequency f becomes nearly equal to 112 kHz.

Figure 7:
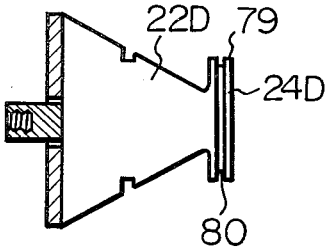
FIG. 7 is a cross-sectional view of a still further modification of the ultrasonic oscillator system, in which an annular groove is formed around the peripheral surface of the resonance plate.

FIG. 7 is a fourth modification of the ultrasonic oscillator system of the ultrasonic atomizing device of the present invention. An annular groove 80 is formed at a peripheral surface 79 of a resonance plate 24D. Other constructions are same as those of the device shown in FIGS. 1 and 2. With this modification, since the annular groove 80 is provided at the intermediate portion of the peripheral surface of the resonance plate 24D, invasion of unwanted liquid into a surface opposite to the operative surface 24D' can be effectively prevented. As a result, impedance variation of the piezoelectric transducer can be minimized and an accident such as a suspention of the atomizing operation can be avoided. Accordingly, stabilization of the atomizing operation can be facilitated.

Finally, a fifth modification of the ultrasonic oscillator system of the ultrasonic atomizing device will be discussed with reference to FIGS. 8 through 11. The oscillator system of this modification is so designed that a diameter of the cross-section of the connecting portion between the circular resonance plate 24E and the coupler 22E substantially agrees with that of the circle enclosed with the nodal line of the primary resonance mode of the resonance plate 24E. Other constructions are same as those of the device shown in FIGS. 2 and 3. Two examples of the ultrasonic oscillator of this modification are illustrated in FIGS. 8 and 9.

In the ultrasonic oscillator system employing the coupler 22E and the resonance plate 24E, a frequency f, a free impedance $Z_{moo}$ and Q value are sometimes largely varied due to the connection diameter between portion of the coupler 22E and the resonance plate 24E.

Figure 8:
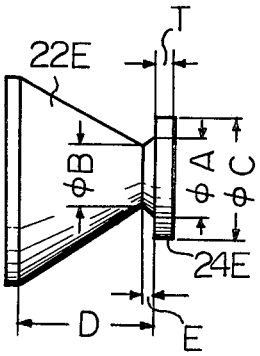
Figure 10:
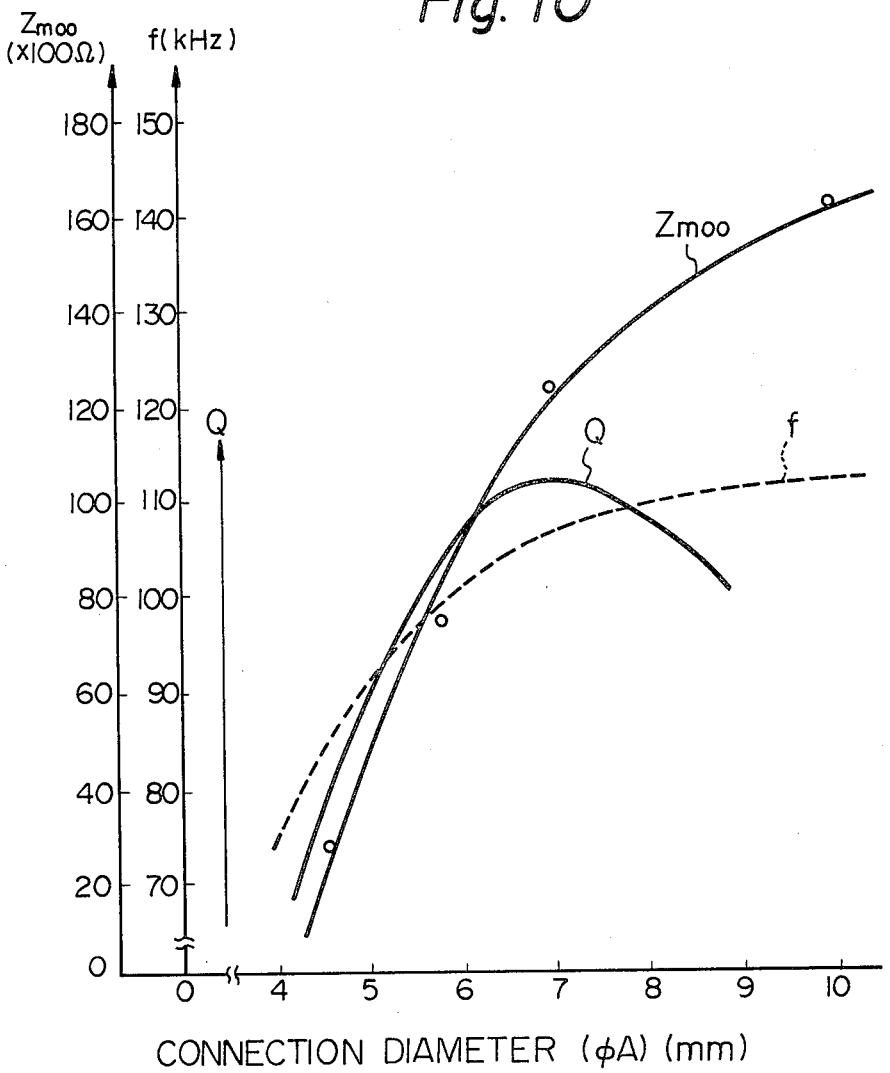

FIG. 10 is a graph showing relationships between the frequency f, free impedance $Z_{moo}$ and Q value, and the connection diameter $\phi$A, respectively, of the oscillator system of FIG. 8 in which the resonance plate 24E is connected to the coupler 22E at the portion where the diameter of the coupler 22E is slightly larger than its smallest diameter. In this example, a diameter $\phi$C of the plate 24E is 10 mm, a thickness T of the same is 1.7 mm, a whole length D of the coupler 22E is 12 mm, a dimension of E is 1 mm, and a diameter $\phi$B is 5 mm, and the coupler 22E is made of stainless steel.

Figure 9:
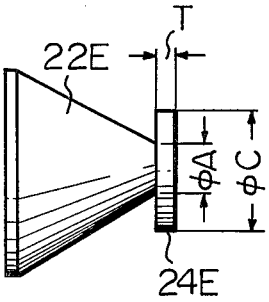
Figure 11:
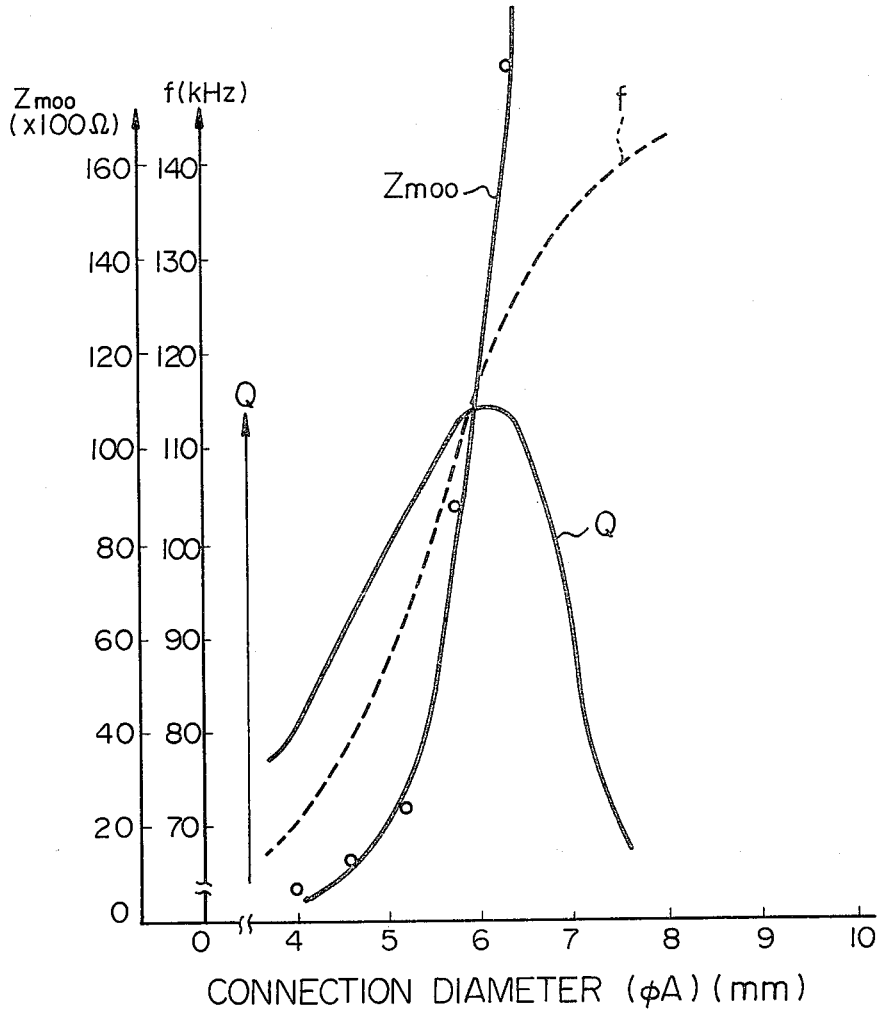

FIG. 11 is a graph showing relationships between the frequency f, free impedance $Z_{moo}$ and Q value, and the connection diameter $\phi$A, respectively, of the oscillator system of FIG. 9 in which the connection diameter between the coupler 22E and the resonance plate 24E coincides with that of the smallest cross-section of the coupler 22E.

As is known from FIGS. 10 and 11, the variations of the free impedance $Z_{moo}$, frequency f and Q value become smaller in the example of FIG. 8 compared to the example of FIG. 9. It is considered that, acoustic reflections to the coupler 22E and the resonance plate 24E become smaller in the example of FIG. 8 compared to the example of FIG. 9, therefore, the bending vibration of this case can be carried out with less energy loss. In which case, however, the Q value becomes maximum where the connection diameter $\phi$A is about 6 to 7 mm and at this point the vibration efficiency becomes also maximum. The connection diameter $\phi$A of 6 to 7 mm corresponds to the diameter of the circle enclosed with the nodal line in the primary resonance mode which is 0.681 time the diameter of the resonance plate 24E. It is found that the vibration efficiency becomes best when the diameter of the node agrees with the connection diameter $\phi$A.

According to the above modification, the diameter of the node in the primary resonance mode of the resonance plate 24E substantially coincides with the connection diameter between the coupler 22E and the resonance plate 24E. Accordingly, the vibration efficiency becomes very excellent. Furthermore, a desired frequency can be readily obtained without serious consideration of material or scattering of the dimension of the coupler, once the dimension and diameter of the coupler are designed to be within a predetermined precision because the coupler effects not longitudinal vibration but bending vibration. Accordingly, mass productivity of the coupler can be improved and production cost can be reduced.

Although particular embodiments of this invention have been described in detail hereinabove, it is apparent that many modifications and variations can be effected therein by those skilled in the art, without departing from the scope or spirit of this invention as defined in the appended claims.

What is claimed is:

1. An ultrasonic atomizing device comprising:

(A) an ultrasonic oscillator system comprising, (a) a conic-frustum shaped rigid coupler including a large cross-sectional surface, a small cross-sectional surface and a conical surface, and having a projection at the central portion of its large cross-sectional surface, (b) a circular piezoelectric plate for effecting vibration, provided with electrode plates on its respective surfaces and having a center hole at the central portion thereof, said piezoelectric plate being coupled with said large cross-sectional surface of said coupler so that said projection of said coupler be inserted into said center hole, (c) a second plate to be stimulated into vibration and integrally formed with said small cross-sectional surface of said coupler, and (d) a pair of feed conductors electrically connected to said electrode plates, respectively, through which being supplied an AC voltage;

(B) a housing having a cylindrical wall, a circular cover fixed at one end of said cylindrical wall and a ring-shaped cover fixed at the other end of the cylindrical wall, and said ring-shaped cover having a circular hole for accepting said coupler;

(C) a ring shaped flexible member for supporting flexibly said coupler in said hole of said ring-shaped cover;

(D) a fixing means for fixing said circular cover of said housing to said projection of said coupler; and (E) an elongated pipe provided on said housing for supplying liquid to be atomized to the operative surface of said second plate.

2. The atomizing device according to claim 1, in which a recess is formed at the central portion of the operative surface of said second plate.

3. The atomizing device according to claim 1, in which as protrusion is formed at the central portion of the operative surface of said second plate.

4. The atomizing device according to claim 1, in which the operative surface of said second plate is a rough one.

5. The atomizing device according to claim 1, in which a groove is formed around the peripherary surface of said second plate.

6. The atomizing device according to anyone of claims 2 to 5, in which said second plate is of circular shape.

7. The atomizing device according to claim 6, in which a connection diameter between said coupler and said second plate substantially coincides with that of a circle enclosed with a nodal line of a primary resonance mode of said second plate.

8. The atomizing device according to claim 1, in which said coupler is made of a conductive material.

9. The atomizing device according to claim 1, in which said projection is an electrical connecting member for connecting electrically one of said paired feed conductors to said one of electrode plates through said coupler.

10. The atomizing device according to claim 1, in which said oscillator system effects bending oscillation.

* * * * *